US011926982B2

(12) United States Patent
Ding et al.

(10) Patent No.: US 11,926,982 B2
(45) Date of Patent: Mar. 12, 2024

(54) ASSEMBLED SUBWAY STATION AND CONSTRUCTION METHOD THEREOF

(71) Applicant: Guangzhou Metro Design & Research Institute Co., Ltd., Guangdong (CN)

(72) Inventors: Xianli Ding, Guangdong (CN); Bao Xiang, Guangdong (CN); Xingzhong Nong, Guangdong (CN); Juyang Wu, Guangdong (CN); Haiou Shi, Guangdong (CN); Feiqi Ou, Guangdong (CN); Zihui Zan, Guangdong (CN); Ran Wang, Guangdong (CN); Shengya He, Guangdong (CN); Xiao Li, Guangdong (CN); Chunjie Liu, Guangdong (CN); Liang Ye, Guangdong (CN); Qian Zhou, Guangdong (CN); Hengyi Li, Guangdong (CN); Wenqi Zhang, Guangdong (CN); Yiheng Ren, Guangdong (CN); He Huang, Guangdong (CN)

(73) Assignee: Guangzhou Metro Design & Research Institute Co., Ltd., Guangzhou (CN)

( * ) Notice: Subject to any disclaimer, the term of this patent is extended or adjusted under 35 U.S.C. 154(b) by 144 days.

(21) Appl. No.: 17/577,373

(22) Filed: Jan. 17, 2022

(65) Prior Publication Data

US 2022/0154419 A1 May 19, 2022

Related U.S. Application Data

(63) Continuation of application No. PCT/CN2020/138754, filed on Dec. 23, 2020.

(30) Foreign Application Priority Data

Nov. 13, 2020 (CN) ..... 202011276099.X

(51) Int. Cl.
*E02D 29/045* (2006.01)
*B61B 1/00* (2006.01)
(Continued)

(52) U.S. Cl.
CPC ..... *E02D 29/04* (2013.01); *B61B 1/00* (2013.01); *E02D 29/16* (2013.01); *E02D 31/02* (2013.01)

(58) Field of Classification Search
CPC ..... E02D 29/045; E02D 29/04; E02D 31/02; E02D 29/16; B61B 1/00; E04B 1/6158; E04B 1/4107; E04B 1/6162
See application file for complete search history.

(56) References Cited

U.S. PATENT DOCUMENTS 5,272,850 A * 12/1993 Mysliwiec ..... E04B 1/6158 52/775
8,147,162 B1 * 4/2012 Burnett ..... F16B 5/0052 312/263

FOREIGN PATENT DOCUMENTS

CN 107524234 A 12/2017
CN 107687213 A 2/2018
(Continued)

*Primary Examiner* — Carib A Oquendo

(57) ABSTRACT

An assembled subway station and a construction method thereof are provided. The assembled subway station includes a plurality of components combined in a ring shape, comprising a bottom plate component, two bottom corner components, two side wall components, a middle plate component, two top corner components, and a top plate component. Connection surfaces of each component are each provided with a concave-convex structure being matched with another concave-convex structure on a relevant connection surface of an adjacent component. Butt joint positions of two adjacent components are filled with sealing structures. The embedded grooves of two adjacent components are oppositely arranged, and connecting mem-
(Continued)

bers for exerting opposite fastening forces on the two adjacent components are installed in the oppositely arranged embedded grooves. The opposite fastening forces are exerted on the two adjacent components through connecting members to ensure sealing structures at the butt joint position and achieve better sealing effects.

5 Claims, 4 Drawing Sheets

(51) Int. Cl.

| | |
|---|---|
| ***E02D 29/00*** | (2006.01) |
| ***E02D 29/16*** | (2006.01) |
| ***E02D 31/02*** | (2006.01) |

(56) References Cited

FOREIGN PATENT DOCUMENTS

| | | | | | |
|---|---|---|---|---|---|
| CN | 107761765 | A | | 3/2018 | |
| CN | 207363038 | U | | 5/2018 | |
| CN | 108222292 | A | | 6/2018 | |
| CN | 207812487 | U | | 9/2018 | |
| CN | 109853908 | A | | 6/2019 | |
| CN | 109881705 | A | | 6/2019 | |
| CN | 112081142 | A | | 12/2020 | |
| DE | 19949694 | A1 | * | 4/2001 | ..... A63C 19/10 |

* cited by examiner

ASSEMBLED SUBWAY STATION AND CONSTRUCTION METHOD THEREOF

CROSS REFERENCE TO RELATED APPLICATIONS

The present application is a Continuation Application of PCT Application No. PCT/CN2020/138754 filed on Dec. 23, 2020, which claims the benefit of Chinese Patent Application No. 202011276099.X filed on Nov. 13, 2020. All the above are hereby incorporated by reference in their entirety.

TECHNICAL FIELD

The present invention relates to the technical field of subway stations, and in particular to an assembled subway station and its construction method.

BACKGROUND

At present, an on-site pouring construction method is usually used to construct a subway station, which includes steps of formwork erecting, steel bar binding, concrete pouring, curing, formwork removing, etc. However, on-site pouring has many problems such as heavy labor, harsh on-site operating conditions, large impact on the surrounding environment, and long construction period.

Based on the above problems, assembled subway station technology is subsequently developed. For example, the Chinese invention patent application with a publication No. CN107761765A published on Mar. 6, 2018 discloses a fully assembled metro station with double-column body structure and a construction method thereof, and specifically, a structure part includes a bottom plate block A for hoisting and positioning. Two upper sides of the bottom plate block A are connected to bottom corner plate blocks B. There are side wall blocks C on the bottom corner plate blocks B. Two lower columns Z are fixed to a middle portion of the bottom plate block A. A left side middle plate block D is fixed to a left side wall block C and a left side lower column Z. A right side middle plate block D is fixed to a right side wall block C and a right side lower column Z. The left side middle plate block D and the right side middle plate block D are each provided with an upper column Z. The upper column Z is provided with a top plate block F. Top corner blocks E are fixed to two sides of the top plate block F and an end of the side wall block C. Connections between the bottom plate block A and the bottom corner plate blocks B, between the bottom corner plate blocks B and the side wall blocks C, between the side wall blocks C and the top corner plate blocks E, between the top corner plate blocks E and the top plate block F, and between the butted middle plate blocks D are achieved through mortise and tenon joints and bolts.

By using the double-column body structure of the fully assembled subway station in the prior art, the construction of the entire subway station can be realized through the assembly and connection of different components, and waterproof gaskets are used in joints between the components to achieve a waterproof effect. However, because the connection portions of the components bear relatively large shearing force and bending moment, bolted connection cannot meet design requirements since it withstands relatively small bending moment. In addition, the bolted connection has uneven force transmission, which is likely to cause structural stress concentration and further structural damage, and the bolted connection cannot meet the high-performance waterproof requirements. Moreover, the operation of screwing bolts is cumbersome and the construction efficiency is low.

SUMMARY

In order to solve the above problems, an objective of the present invention is to provide an assembled subway station and a construction method thereof, so as to solve the problems that existing bolted connection for components cannot meet the design requirements since it withstands relatively small bending moment, besides, the bolted connection has uneven force transmission, which is likely to cause structural stress concentration and further structural damage, further the bolted connection cannot meet the high-performance waterproof requirements, and furthermore, the operation of screwing bolts is cumbersome and the construction efficiency is low.

A technical solution of the assembled subway station of the present invention is as follows.

An assembled subway station, comprising a plurality of components combined in a ring shape, wherein the plurality of components comprise a bottom plate component, two bottom corner components, two side wall components, a middle plate component, two top corner components, and a top plate component. The bottom corner components are connected to two lateral sides of the bottom plate component, the top corner components are connected to two lateral sides of the top plate component, the side wall components are connected to two lateral sides of the middle plate component, and the side wall components are connected between the bottom corner components and the top corner components.

Connection surfaces of each component are each provided with a concave-convex structure being matched with another concave-convex structure on a relevant connection surface of an adjacent component, butt joint positions of two adjacent components are filled with sealing structures, the connection surfaces of each component are further each provided with embedded grooves extending in a longitudinal direction, the embedded grooves of two adjacent components are oppositely arranged, and connecting members for exerting opposite fastening forces on the two adjacent components are installed in the oppositely arranged embedded grooves.

Further, the respective embedded groove is a C-shaped groove, a notch of the C-shaped groove faces outwards, and outer groove edges of the C-shaped groove are in stop fit with a connecting member.

Further, the connection surfaces of each component are further each provide with C-shaped channel steels, the C-shaped channel steels are each connected to a main steel bar of the each component and are each provided with anchors, and inner channels of the C-shaped channel steels form the C-shaped grooves.

Further, the respective connecting member is a H-shaped steel, the H-shaped steel comprises two side flanges and a middle web, the two side flanges are respectively in stop fit with outer groove edges of two opposite C-shaped grooves, and the web is in clearance fit with the notches of the two opposite C-shaped grooves.

Further, a high-strength grouting material is further poured into gaps between the two oppositely arranged C-shaped grooves and the H-shaped steel.

Further, the H-shaped steel is provided with first wedge structures, and the first wedge structures each have a first wedge surface arranged obliquely in a length direction of the H-shaped steel. The C-shaped grooves are each provided with second wedge structures, and second wedge surfaces of the second wedge structures are laterally compress-fitted with the first wedge surfaces.

Further, the sealing structures each comprise a sealing strip arranged on a connection surface of each component, and the sealing strip has a sealing surface oppositely compress-fitted with another sealing surface of a relevant sealing strip of an adjacent component. The sealing structures each further comprise epoxy resin filled between two adjacent components.

Beneficial effects: in the assembled subway station, the bottom plate component, the bottom corner components, the side wall components, the top corner components, and the top plate component are combined to form a ring structure. After two adjacent components are butt jointed in place, the concave-convex structures on the connection surfaces of the two adjacent components play a positioning action. When the embedded grooves of the two adjacent components are opposite each other, connecting members are inserted in the oppositely arranged embedded grooves of the two adjacent components, and opposite fastening forces are exerted on the two adjacent components through the connecting members. The existing bolted connection form is replaced with such connection form, ensuring that the sealing structures at the butt joint positions can achieve a better sealing effect. The connecting members and the embedded grooves are assembled together, and the entire connecting assembly replaces a plurality of bolted structures, so that stronger and more reliable fastening forces are exerted on two adjacent components. Moreover, this connection form bears greater bending moments, force transmission is even, and stress concentration is reduced significantly, so that joint cracking due to structural damage is avoided, and the high-performance waterproof requirements are met. Moreover, compared with bolt screwing, the operation is simplified and the construction efficiency is improved.

A technical solution of a construction method of an assembled subway station of the present invention is as follows.

A construction method of an assembled subway station includes the following steps of:

Step I: prefabricating a plurality of components, providing each connection surface of each component with a concave-convex structure and C-shaped grooves, and manufacturing H-shaped steels;

Step II: placing the components at butt joint positions according to an assembly sequence to make notches of the C-shaped grooves of adjacent components opposite each other;

Step III: inserting the H-shaped steels into the C-shaped grooves of two adjacent components to exert opposite fastening forces on the two adjacent components;

Step IV: pouring a high-strength grouting material into gaps between the C-shaped grooves and the H-shaped steels; and step V: filling epoxy resin between adjacent components to achieve seal.

Further, in step I, the C-shaped channel steels are each provided with anchors, the C-shaped channel steels are pre-embedded in the connection surfaces of each component with notches outward and are connected to main steel bars of each component, and after the components are prefabricated, sealing strips are arranged on the connection surfaces of each component.

Further, in step I, each H-shaped steel is provided with first wedge structures, the first wedge structures each have a first wedge surface arranged obliquely in a length direction of the H-shaped steels, and the C-shaped channel steels are each provided with second wedge structures.

In step III, when the H-shaped steels are inserted, the first wedge structures of the H-shaped steels are used to form a lateral compression fit with the second wedge structures of the C-shaped channel steels of adjacent components.

Beneficial effects: in the assembled subway station, the bottom plate component, the bottom corner components, the side wall components, the top corner components, and the top plate component are combined to form a ring structure. After two adjacent components are butt jointed in place, the concave-convex structures on the connection surfaces of the two adjacent components play a positioning action. When the embedded grooves of the two adjacent components are opposite each other, connecting members are inserted in the oppositely arranged embedded grooves of the two adjacent components, and opposite fastening forces are exerted on the two adjacent components through the connecting members. The existing bolted connection form is replaced with such connection form, ensuring that the sealing structures at the butt joint positions can achieve a better sealing effect. The connecting member and the embedded grooves are assembled together, and the entire connecting assembly replaces a plurality of bolted structures, so that stronger and more reliable fastening forces are exerted on two adjacent components. Moreover, this connection form bears greater bending moments, force transmission is even, and stress concentration is reduced significantly, so that joint cracking due to structural damage is avoided, and the high-performance waterproof requirements are met. Moreover, compared with bolt screwing, the operation is simplified and the construction efficiency is improved.

Figure 1:
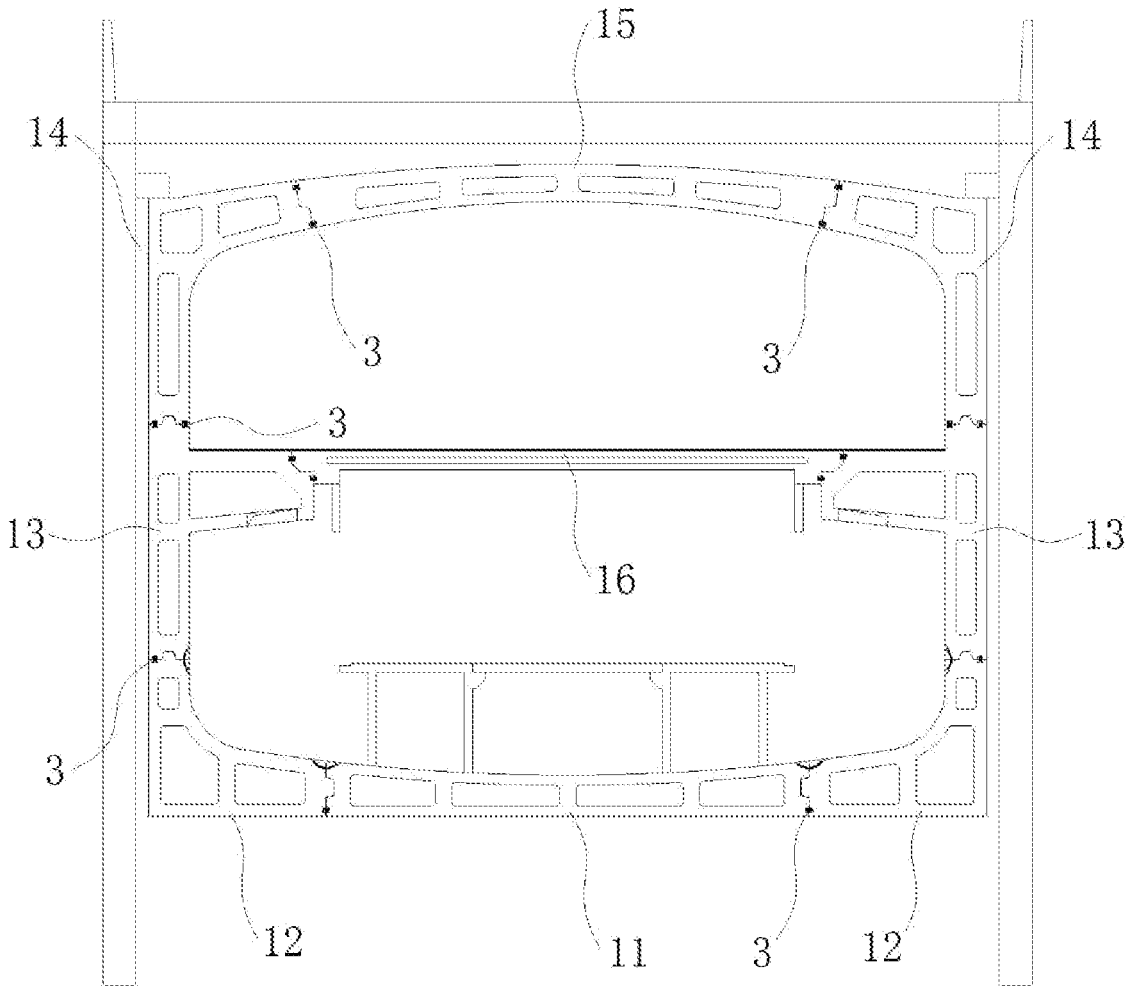
FIG. 1 is a schematic cross-sectional structure diagram of an assembled subway station in a specific embodiment 1 of an assembled subway station according to the present invention.
Figure 2:
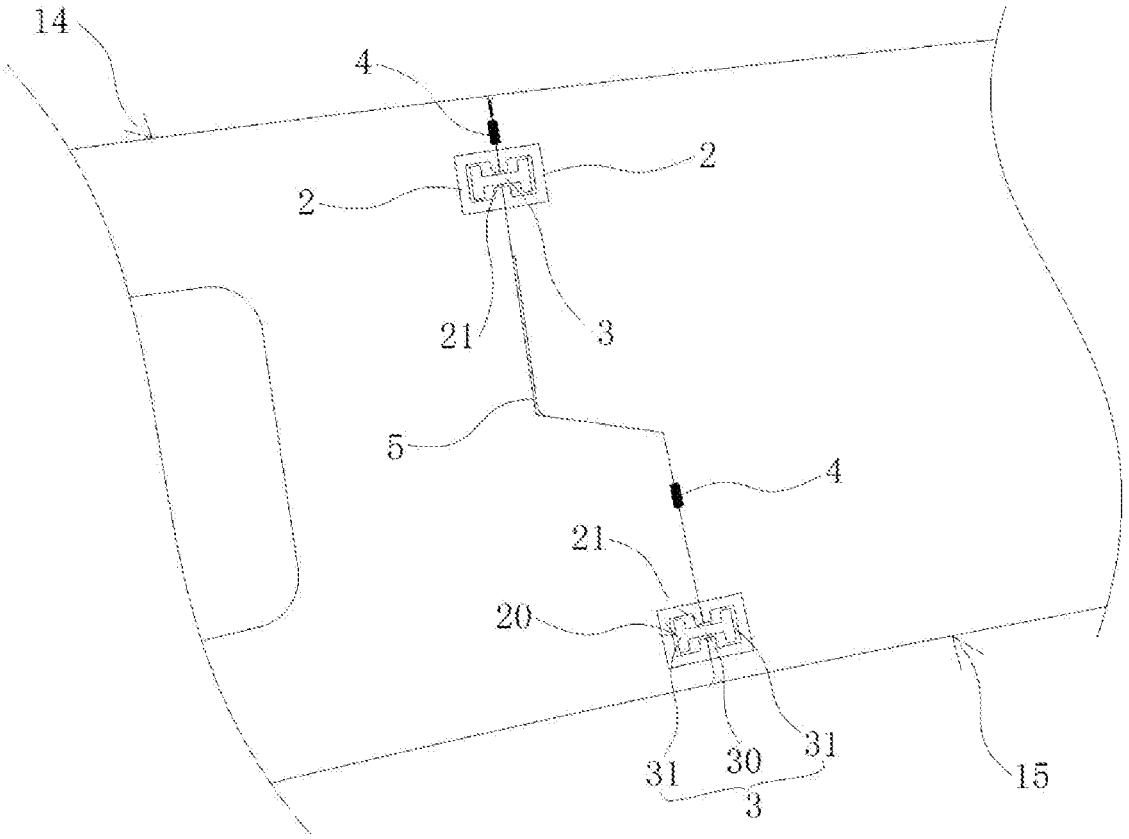
FIG. 2 is an enlarged schematic view of a connection position between a top corner component and a top plate component in FIG. 1.
Figure 3:
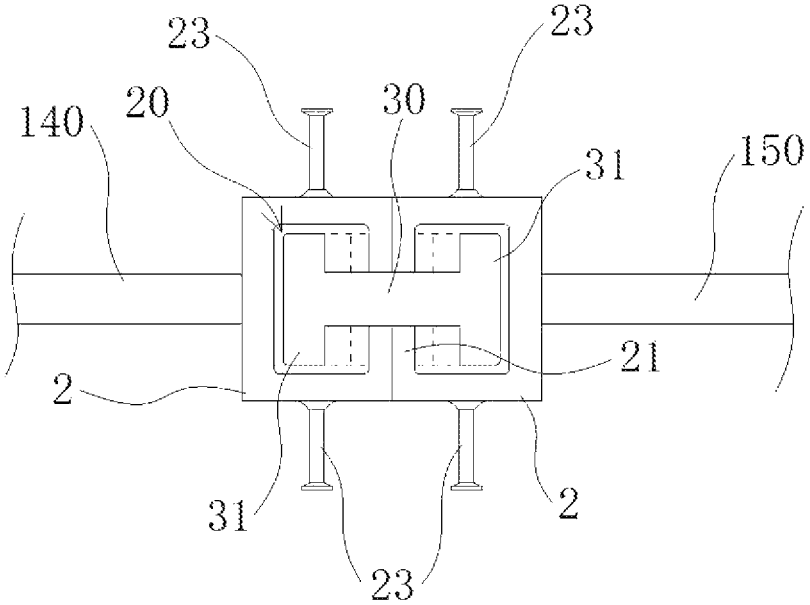
FIG. 3 is a schematic diagram showing assembly between an H-shaped steel and two C-shaped channel steels in the specific embodiment 1 of an assembled subway station according to the present invention.
Figure 4:
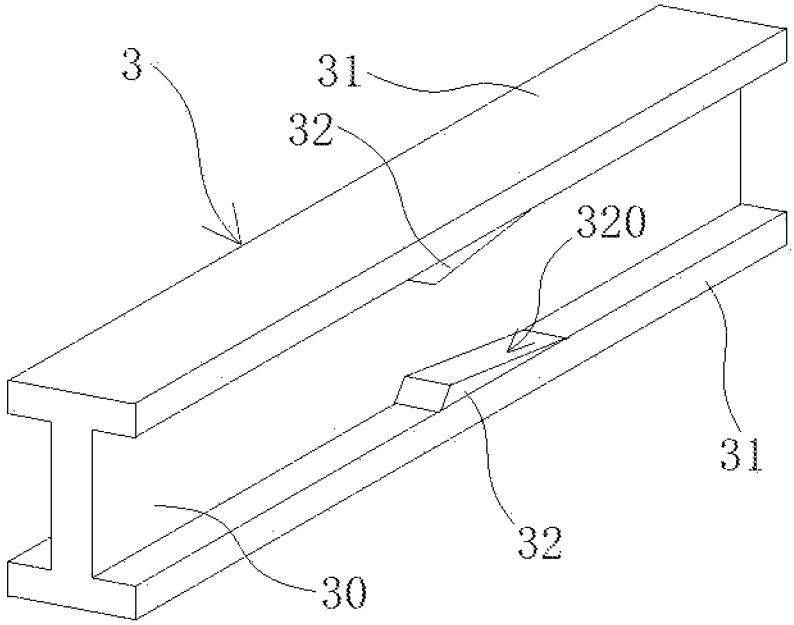
FIG. 4 is a three-dimensional schematic diagram of the H-shaped steel in the specific embodiment 1 of an assembled subway station according to the present invention.
Figure 5:
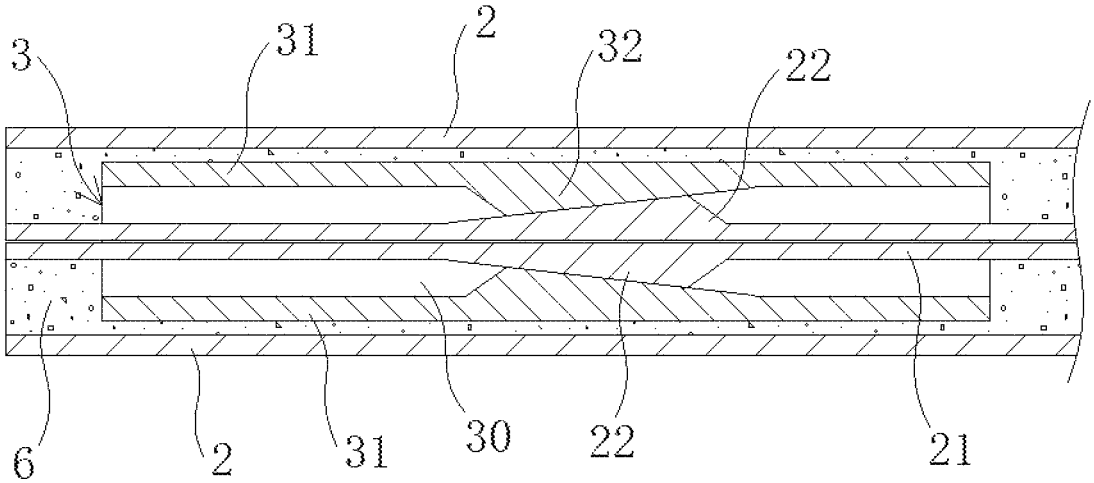
FIG. 5 is a longitudinal cross-sectional view of the H-shaped steel installed in the two C-shaped channel steels in the specific embodiment 1 of the assembled subway station according to the present invention.

In the drawings: 11—bottom plate component, 12—bottom corner component, 13—side wall component, 131—convex edge of side wall component, 14—top corner component, 140—main steel bar of top corner component, 141—concave edge of top corner component, 15—top plate component, 150—main steel bar of top plate component, 16—middle plate component, 2—C-shaped channel steel, 20—C-shaped groove, 21—outer groove edge, 22—second wedge structure, 23—anchor, 3—H-shaped steel, 30—web, 31—side flange, 32—first wedge structure, 320—first wedge surface, 4—sealing strip, 5—epoxy resin, and 6—high-strength grouting material.

DETAILED DESCRIPTION

The specific implementations of the present invention are described in more detail below with reference to the accompanying drawings and embodiments. The following embodiments are illustrative of the present invention and should not be construed as limiting of the scope of the present invention.

In a specific embodiment 1 of an assembled subway station according to the present invention, as shown in FIG. 1 to FIG. 6, an assembled subway station includes a plurality of components combined in a ring shape. The plurality of components include a bottom plate component 11, two bottom corner components 12, two side wall components 13, two top corner components 14, and a top plate component 15. The bottom corner components 12 are connected to two lateral sides of the bottom plate component 11, the top corner components 14 are connected to two lateral sides of the top plate component 15, and the side wall components 13 are connected between the bottom corner components 12 and the top corner components 14. Connection surfaces of each component are each provided with a concave-convex structure being matched with another concave-convex structure on a relevant connection surface of an adjacent component. Butt joint positions of two adjacent components are filled with sealing structures. The connection surfaces of each component are further each provided with embedded grooves extending in a longitudinal direction, the embedded grooves of two adjacent components are oppositely arranged, and connecting members for exerting opposite fastening forces on the two adjacent components are installed in oppositely arranged embedded grooves.

In the assembled subway station, the bottom plate component 11, the bottom corner components 12, the side wall components 13, the top corner components 14, and the top plate component 15 are combined to form a ring structure. After two adjacent components are butt jointed in place, the concave-convex structures on the connection surfaces of the two adjacent components play a positioning action. When the embedded grooves of the two adjacent components are opposite each other, connecting members are inserted in the oppositely arranged embedded grooves of the two adjacent components, and opposite fastening forces are exerted on the two adjacent components through the connecting members. The existing bolted connection form is replaced with such connection form, ensuring that the sealing structures at the butt joint positions can achieve a better sealing effect. The connecting members and the embedded grooves are assembled together, and the entire connecting assembly replaces a plurality of bolted structures, so that stronger and more reliable fastening forces are exerted on two adjacent components. Moreover, this connection form bears greater bending moments, force transmission is even, and stress concentration is reduced significantly, so that joint cracking due to structural damage is avoided, and the high-performance waterproof requirements are met. Moreover, compared with bolt screwing, the operation is simplified and the construction efficiency is improved.

The bottom plate component 11 and the bottom corner components 12 are connected by a combination of a connecting assembly and bent bolts. The bottom corner components 12 and the side wall components 13 are connected by a combination of a connecting assembly and bent bolts. The side wall components 13 and the top corner components 14 are connected by double connecting assemblies. The top corner components 14 and the top plate component 15 are connected by double connecting assemblies. In addition, a middle plate component 16 is also connected between the two side wall components 13, and the side wall components 13 and the middle plate component 16 are also connected by double connecting assemblies. Because the lower half part of the assembled subway station itself is not load-bearing, the corresponding components are connected by a combination of a connecting assembly and bent bolts, and a single connecting assembly can meet the requirements of the connection strength between the corresponding components. The upper half part of the assembled subway station not only acts as a load-bearing structure, but also needs to possess a waterproof function, so that the components are connected by double connecting assemblies to meet higher requirements for connection strength.

In the present embodiment, the respective embedded groove is a C-shaped groove 20, a notch of the C-shaped groove 20 faces outwards, and outer groove edges 21 of the C-shaped groove 20 are in stop fit with a connecting member. Specifically, the connection surfaces of each component are each pre-embedded with C-shaped channel steels 2 which are connected to main steel bars of each component and each further provided with anchors 23. Inner channels of the C-shaped channel steels 2 form the C-shaped grooves 20. Taking a joint structure between a top corner component 14 and a top plate component 15 as an example, the upper connection surface of the top corner component 14 is provided with a stepped outer edge and two C-shaped channel steels 2 pre-embedded in the top corner component 14. The two C-shaped channel steels 2 are both connected to main steel bars 140 of the top corner component, and the two C-shaped channel steels 2 are each further provided with anchors 23. The anchors 23 are used to improve the bonding strength between the C-shaped channel steels 2 and concrete parts of the top corner component 14, thereby ensuring that the C-shaped channel steels 2 and the top corner component 14 form a complete structure.

Figure 6:
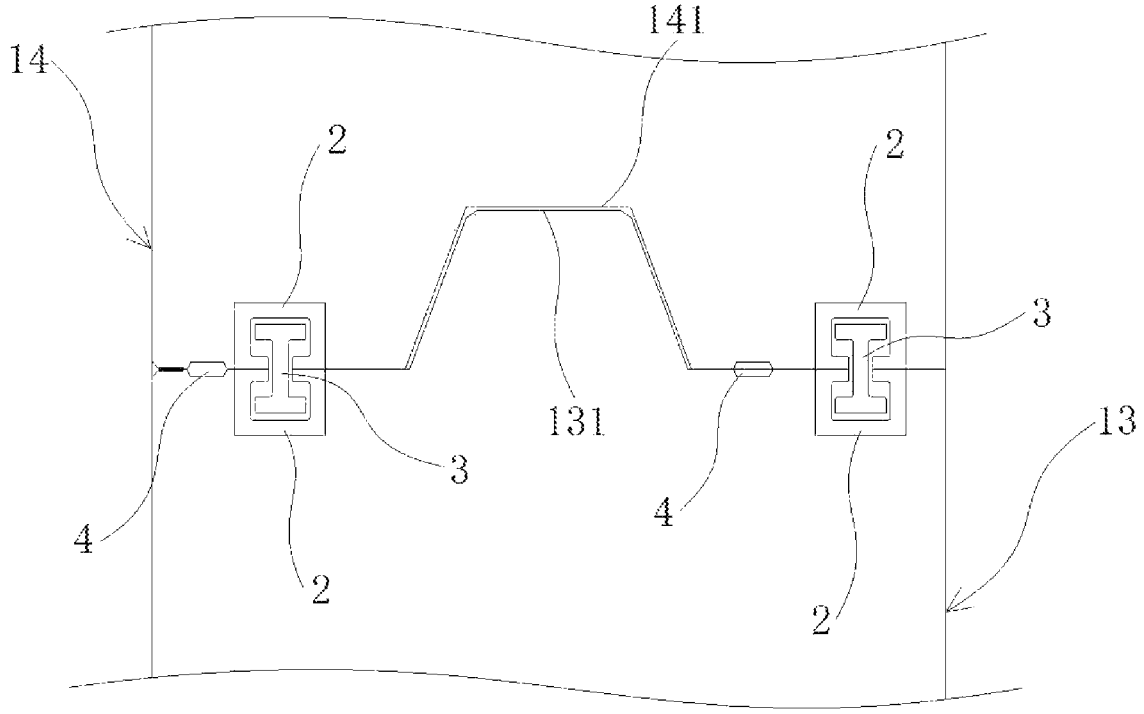
FIG. 6 is an enlarged schematic view of a connection position between a top corner component and a side wall component in FIG. 1.

Correspondingly, the side connection surface of the top plate component 15 is also provided with a stepped outer edge and two C-shaped channel steels 2 pre-embedded in the top plate component 15. The two C-shaped channel steels 2 are both connected to main steel bars 150 of the top plate component, and are each provided with anchors which are used to improve the bonding strength between the C-shaped channel steels 2 and concrete parts of the top plate component 15, thereby ensuring that the C-shaped channel steels 2 and the top plate component 15 form a complete structure. The stepped outer edge of the top corner component 14 is in concave-convex fit with the stepped outer edge of the top plate component 15, so as to play a positioning and support role. The stepped outer edge of the top corner component 14 and the stepped outer edge of the top plate component 15 form the concave-convex structures of the connection surfaces of the components. In addition, as shown in FIG. 6, the lower connection surface of the top corner component 14 is provided with a concave edge 141 of the top corner component, and the corresponding connection surface of the side wall component 13 is provided with a convex edge 131 of the side wall component. The concave edge 141 of the top corner component and the convex edge 131 of the side wall component are in concave-convex fit, and respectively form a concave-convex structure of the respective component.

In the present embodiment, the respective connecting member is a H-shaped steel 3. The H-shaped steel 3 includes two side flanges 31 and a middle web 30. The two side flanges 31 are respectively in stop fit with outer groove edges 21 of two opposite C-shaped grooves 20. The web 30 is in clearance fit with notches of the two opposite C-shaped grooves 20. During construction, after two adjacent components are butt jointed in place, the H-shaped steels 3 are inserted into the C-shaped grooves 20 of the two components in the longitudinal direction, the web 30 of each H-shaped steel 3 enters the notches of the C-shaped grooves 20, and the two side flanges 31 of each H-shaped steel 3 are used for being in stop fit with the outer groove edges 21 of the oppositely arranged C-shaped grooves 20 respectively. Since the web 30 of each H-shaped steel 3 is of a longitudinal continuous structure and has high strength, high-strength fastening connection between two adjacent components can be ensured.

In order to improve the sealing connection effect on the components, each H-shaped steel 3 is provided with first wedge structures 32 which each have a first wedge surface 320 arranged obliquely in a length direction of the H-shaped steels 3. Each C-shaped groove 20 is provided with second wedge structures 22 which are laterally compress-fitted with the first wedge surfaces 320. Specifically, two first wedge structures 32 are provided, and the two first wedge structures 32 are arranged symmetrically on opposite sides of two side flanges 31 of each H-shaped steel 3, and the opposite surfaces of the two first wedge structures 32 are the first wedge surfaces 320.

Correspondingly, inner side surfaces of the outer groove edges 21 of each C-shaped channel steel 2 are each provided with a second wedge structure 22, an inclined surface of the second wedge structure 22 is arranged obliquely in a length direction of the C-shaped channel steels 2, and an inclination angle of the inclined surface of the respective second wedge structure 22 is equal to inclination angles of the first wedge surface 320 of the respective first wedge structure 32. Due to the design of the first wedge structures 32 and the second wedge structures 22, as the H-shaped steels 3 gradually are inserted into the C-shaped grooves 20 of two adjacent components, longitudinal movement of the two first wedge structures 32 is converted into lateral compression forces on the second wedge structures 22 of the two C-shaped channel steels 2, such that the two adjacent components are tightly connected to achieve good seal.

In addition, a high-strength grouting material 6 is further poured into gaps between the C-shaped grooves 20 and the H-shaped steels 3. The high-strength grouting material 6 itself has good pressure resistance characteristics. By using the high-strength grouting material 6 to fill the gaps, among others, the cured high-strength grouting material 6 completely restricts the H-shaped steels 3, such that the H-shaped steels 3 are firmly and stably stationary in the C-shaped grooves 20, ensuring that the H-shaped steels 3 can reliably connect the components.

In the present embodiment, the sealing structures each includes sealing strips 4 arranged on the connection surfaces of the components, and the sealing strips 4 each have a sealing surface oppositely compress-fitted with another sealing surface of a relevant sealing strip 4 of an adjacent component. The sealing structures each further include epoxy resin 5 filled between two adjacent components. Through the sealing strips 4 and close sealing between the sealing strips 4, and the epoxy resin 5 filling gaps between two adjacent components, the sealing form and effective sealing area are increased, so that the actual sealing effect between the components is better.

A construction method of an assembled subway station includes the following steps of.

Step I: prefabricating a plurality of components, and providing each connection surface of each component with a concave-convex structure and C-shaped grooves 20, wherein, C-shaped channel steels 2 are first provide with second wedge structures 22 and anchors 23, the C-shaped channel steels 2 are pre-embedded in the connection surfaces of the components with notches outward, and the C-shaped channel steels 2 are connected to main steel bars of the components, inner channels of the C-shaped channel steels 2 form the C-shaped grooves 20, and after the components are prefabricated, sealing strips 4 are arranged on the connection surfaces of the components;

Wherein in step I, H-shaped steels 3 are manufactured, specifically, the H-shaped steels 3 are each provided with first wedge structure 32, and the first wedge structures 32 each have a first wedge surface 320 arranged obliquely in a length direction of the H-shaped steels 3;

Step II: placing the components at butt joint positions according to an assembly sequence to make notches of the C-shaped grooves 20 of two adjacent components opposite each other;

Step III: inserting the H-shaped steels 3 into the C-shaped grooves 20 of two adjacent components to exert opposite fastening forces on the two adjacent components, specifically, in step III, when an H-shaped steel 3 is inserted, the first wedge structures 32 of the H-shaped steel are laterally compress-fitted with the second wedge structures 22 of the C-shaped channel steels 2 of two adjacent components, respectively;

Step IV: pouring a high-strength grouting material 6 into gaps between the C-shaped grooves 20 and the H-shaped steels 3; and Step V: filling epoxy resin 5 between two adjacent components to achieve seal.

In other specific embodiments of the assembled subway station of the present invention, in order to meet different construction requirements, the first wedge structures of the H-shaped steels and/or the second wedge structures of the C-shaped channel steels may be omitted. The sizes of the H-shaped steels and the C-shaped channel steels are precisely matched to realize connection between two components.

The specific embodiments of the construction method of an assembled subway station of the present invention are the same as the specific embodiments of the construction method of an assembled subway station in the specific implementations of the assembled subway station of the present invention, and will not be repeated here.

The foregoing descriptions are only preferred implementations of the present invention. It should be noted that several improvements and replacements may further be made by a person of ordinary skill in the art without departing from the principle of the present invention, and such improvements and replacements should also be deemed as falling within the protection scope of the present invention.

The invention claimed is:

1. An assembled subway station, comprising a plurality of components combined in a ring shape, wherein the plurality of components comprise a bottom plate component, two bottom corner components, two side wall components, a middle plate component, two top corner components, and a top plate component, the bottom corner components are connected to two lateral sides of the bottom plate component, the top corner components are connected to two lateral sides of the top plate component, the side wall components are connected to two lateral sides of the middle plate component, and the side wall components are connected between the bottom corner components and the top corner components;

connection surfaces of each component are each provided with a concave-convex structure being matched with another concave-convex structure on a relevant connection surface of an adjacent component, butt joint positions of two adjacent components are filled with sealing structures, the connection surfaces of each component are further each provided with embedded grooves extending in a longitudinal direction, the embedded grooves of two adjacent components are oppositely arranged, and connecting members for exerting opposite fastening forces on the two adjacent components are installed in the oppositely arranged embedded grooves;

the respective embedded groove is a C-shaped groove, a notch of the C-shaped groove faces outwards, and outer groove edges of the C-shaped groove are in stop fit with a connecting member;

the respective connecting member is a H-shaped steel, the H-shaped steel comprises two side flanges and a middle web, the two side flanges are respectively in stop fit with outer groove edges of two oppositely arranged C-shaped grooves, and the web is in clearance fit with the notches of the two oppositely arranged C-shaped grooves; and the H-shaped steel is provided with first wedge structures, the first wedge structures each have a first wedge surface arranged obliquely in a length direction of the H-shaped steels, the C-shaped grooves are each provided with second wedge structures, and the second wedge structures are laterally compress-fitted with the first wedge surfaces.

2. The assembled subway station according to claim 1, wherein the connection surfaces of each component are each further provide with C-shaped channel steels, the C-shaped channel steels are each connected to main steel bars of the each component and are each provided with anchors, and inner channels of the C-shaped channel steels form the C-shaped grooves.

3. The assembled subway station according to claim 1, wherein a high-strength grouting material is further poured into gaps between the oppositely arranged C-shaped grooves and the H-shaped steel.

4. The assembled subway station according to claim 1, wherein the sealing structures each comprise a sealing strip arranged on a connection surface of each component, the sealing strip has a sealing surface oppositely compress-fitted with another sealing surface of a relevant sealing strip of an adjacent component, and the sealing structures each further comprise epoxy resin filled between two adjacent components.

5. A construction method of an assembled subway station, comprising the following steps of:

step I: prefabricating a plurality of components, providing each connection surface of each component with a concave-convex structure and C-shaped grooves, and manufacturing H-shaped steels;

step II: placing the components at butt joint positions according to an assembly sequence to make notches of the C-shaped grooves of adjacent components opposite each other;

step III: inserting the H-shaped steels into the C-shaped grooves of adjacent components to exert opposite fastening forces on two adjacent components;

step IV: pouring a high-strength grouting material into gaps between the C-shaped grooves and the H-shaped steels; and step V: filling epoxy resin between adjacent components to achieve seal, wherein in step I, the C-shaped channel steels are each provided with anchors, the C-shaped channel steels are pre-embedded in the connection surfaces of each component with notches outward and are connected to main steel bars of each component, and after the components are prefabricated, sealing strips are arranged on the connection surfaces of each component;

in step I, each H-shaped steel is provided with first wedge structures, the first wedge structures each have a first wedge surface arranged obliquely in a length direction of the H-shaped steels, and the C-shaped channel steels are each provided with second wedge structures; and in step III, when the H-shaped steels are inserted, the first wedge structures of the H-shaped steels are used to form a lateral compression fit with the second wedge structures of the C-shaped channel steels of adjacent components.

* * * * *